United States Patent [19]

Nichols

[11] Patent Number: 5,052,061

[45] Date of Patent: Oct. 1, 1991

[54] TOILET SEAT LATCHING DEVICE

[76] Inventor: Victor Nichols, 79 Tisdale Avenue, Toronto, Ontario, Canada, M4A 1Y6

[21] Appl. No.: 555,007

[22] Filed: Jul. 20, 1990

[51] Int. Cl.[5] ..... E03D 9/00

[52] U.S. Cl. ..... 4/661

[58] Field of Search ..... 4/253, 661, 234, 241, 4/251

[56] References Cited

U.S. PATENT DOCUMENTS

| | | | |
|---|---|---|---|
| 2,404,124 | 7/1946 | Des Roches | 4/253 |
| 2,558,578 | 6/1951 | Palmieri | 4/253 |
| 3,048,854 | 8/1962 | Miller | 4/253 |
| 3,477,070 | 11/1969 | Kimber | 4/253 X |
| 4,145,771 | 3/1979 | Khazin | 4/253 |
| 4,451,940 | 6/1984 | Grunz | 4/234 |
| 4,638,515 | 1/1987 | Caputo et al. | 4/661 |
| 4,763,362 | 8/1988 | Eure | 4/234 |
| 4,839,928 | 6/1989 | Probasco | 4/251 |

*Primary Examiner*—Henry J. Recla
*Assistant Examiner*—Robert M. Fetsuga
*Attorney, Agent, or Firm*—Rogers, Bereskin & Parr

[57] ABSTRACT

This invention relates to a latching device for a toilet seat. This device includes a strap, one end of which is attached to the top edge of the toilet's water tank. The other end of the strap is releasably secured to the bottom of the toilet seat by a hook-and-loop fastener, respective members of which are attached to the end of the strap and to the bottom of the seat. The hook-and-loop fastener allows attachment and detachment at will.

2 Claims, 4 Drawing Sheets

TOILET SEAT LATCHING DEVICE

FIELD OF THE INVENTION

This invention relates generally to toilet seats and in particular to devices for supporting toilet seats in the upright or vertical position.

BACKGROUND OF THE INVENTION

A common problem in the use of a toilet is that the seat, and sometimes the cover as well, will not stay in the upright or vertical position. This problem is especially common when there is a covering on the toilet seat cover or the water tank. Supporting the cover and the seat oneself can be awkward or even dangerous.

Several devices have been developed to deal with this problem, but they each have disadvantages.

A toilet hook has been disclosed under U.S. Pat. No. 4,638,515 (Caputo et al). Caputo discloses an apparatus for releasably maintaining a toilet seat in a generally vertical or upright position. One member of the apparatus is adapted to be fixed to the toilet tank. A second member, which has a hook at the top of it, is attached to the first member such that the hook meets the seat and cover at their vertical or upright position and holds them. The seat and cover are released by either lifting or swivelling the second member relative to the first. This action removes the hook from its position maintaining the seat and cover. The size and complexity of this device contribute toward its production costs. In addition, a significant portion of the apparatus would be visible when it is not in use. This could be considered undesirable to some who do not like the aesthetics of this device.

U.S. Pat. No. 4,763,362 (Eure) discloses a latching device for a toilet seat. The Eure device has an elongate strap adhesively secured at one end to the top of a toilet seat cover. One member of a hook-and-loop fastener is attached to the other end of the strap. The other member of the hook and loop fastener is adhesively secured to the bottom of the toilet seat. The two members of the hook-and-loop fastener are brought together to hold the seat and the cover together, however there is nothing holding the cover vertical. If the cover falls down, so will the seat. In addition, as with the Caputo apparatus, a substantial portion of this device is visible when not in use.

Another device is disclosed in U.S. Pat. No. 4,451,940 (Grunz) which holds a toilet seat and its cover together by way of magnets. These magnets are placed in corresponding positions on the top of the seat and the bottom of the cover. As with the Eure device, the cover is not held vertical so that the cover and the seat could fall down together.

SUMMARY OF THE INVENTION

A latching device is provided for a toilet having a water tank, a seat and cover, said water tank having a front wall adjacent to said seat and said cover and having a rear wall opposite said front wall, said latching device comprising a strap having attaching means at a first end thereof for attaching said strap to said water tank and releasable securing means for releasably securing a second end thereof to one of said seat and said cover.

DESCRIPTION OF THE DRAWINGS

Preferred embodiments of the present invention will now be described with reference to the drawings in which.

DESCRIPTION OF PREFERRED EMBODIMENTS

Figure 1:
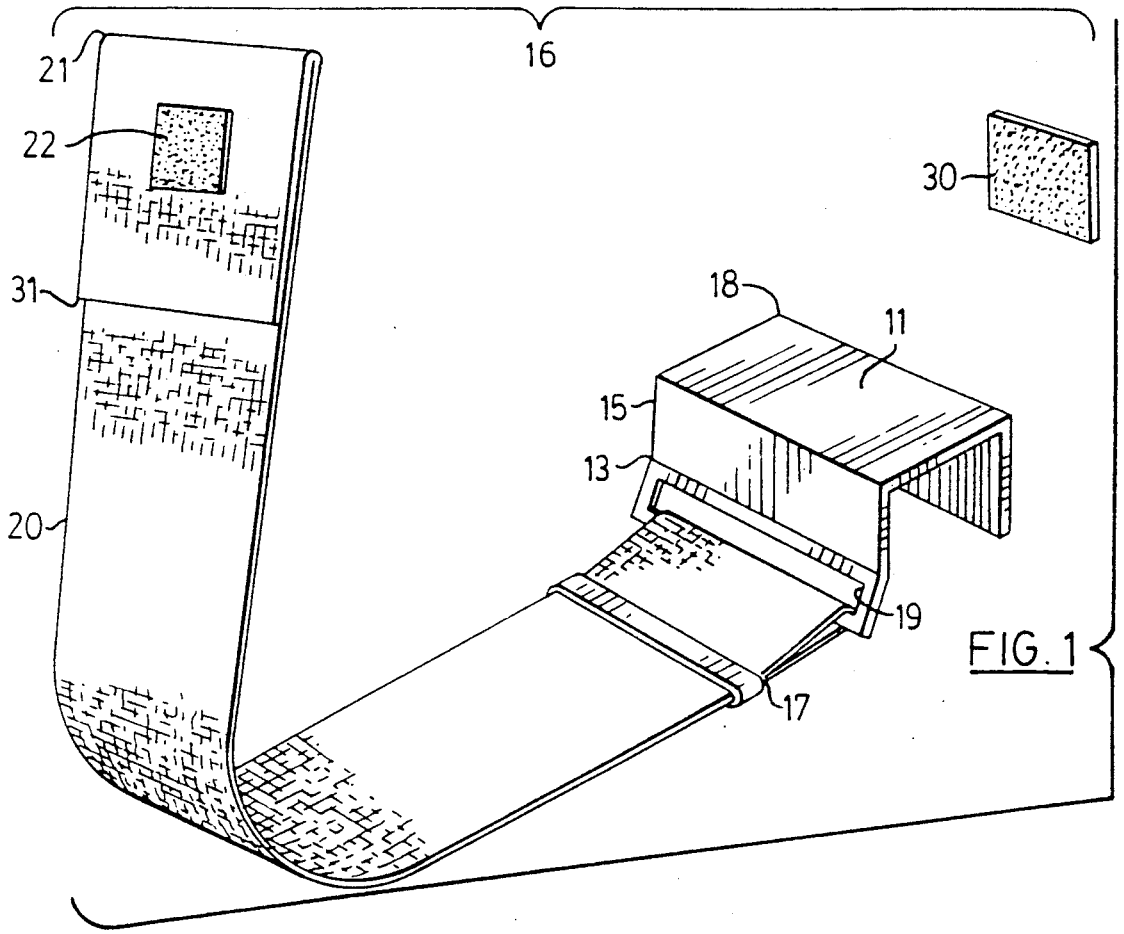
FIG. 1 is an isometric view of a latching device according to the present invention.

Referring to FIG. 1, a latching device is generally indicated by reference 16. The latching device has a generally elongated strap 20 of an elastic material which is attached at a first end 17 to a generally U-shaped hook 18. The second or opposite end 21 of the strap 20 is covered by a head piece 31. Attached to the head piece 31 is one member 22 of a releasable securing means 9. The opposite member 30 of the releasable securing means 9 may also be included as part of the latching device 16. The preferred releasable securing means 9 as shown is a hook-and-loop fastener such as sold under the VELCRO trademark. Presumably however, other releasable fasteners, such as dome fasteners or magnets, might be substituted.

The hook 18 is sized to fit over the top edge of the wall of a toilet tank and to allow a tank lid to be placed on top. The hook may be made of plastic, sheet metal or other relatively stiff material.

One arm 15 of the hook 18 has a slot 19 in it through which passes the end 17 of the strap 20. The end 17 is looped through the slot 19 and sewn to itself.

The U-shape of the hook 18 may be modified. The one arm 15 of the hook 18 may be bent away slightly from the other arm at a location 13 part-way down its length so that the slot 19 is located entirely on the bent away portion. This will avoid chafing of the end 17 of the strap 20 against the wall of the toilet tank when the hook is mounted on the toilet tank.

Figure 2:
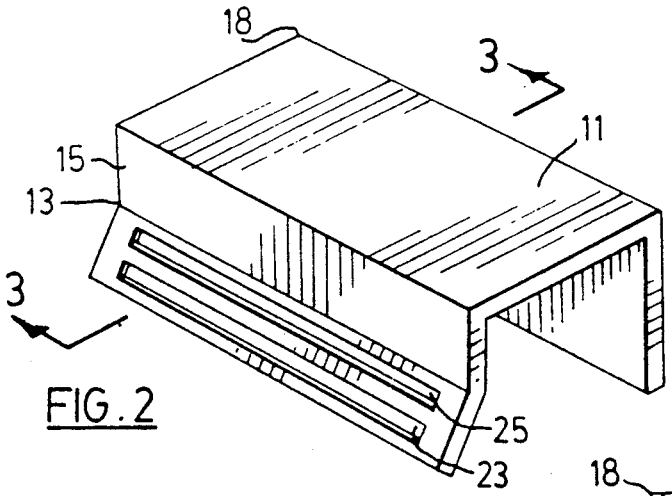
FIG. 2 is an isometric view of an alternate hook portion for a latching device according to the present invention.
Figure 3:
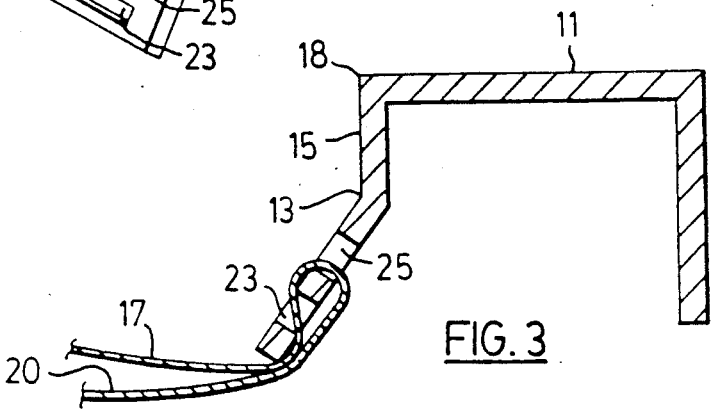
FIG. 3 is a sectional view along line 3—3 of the hook of FIG. 2.

FIG. 2 shows an alternate hook design in which the hook 18 has two slots 23 and 25 instead of one. This enables the strap 20 to be threaded therethrough as shown in dashed outline in FIG. 3, to enable the effective length of the strap 20 to be adjusted.

Figure 6:
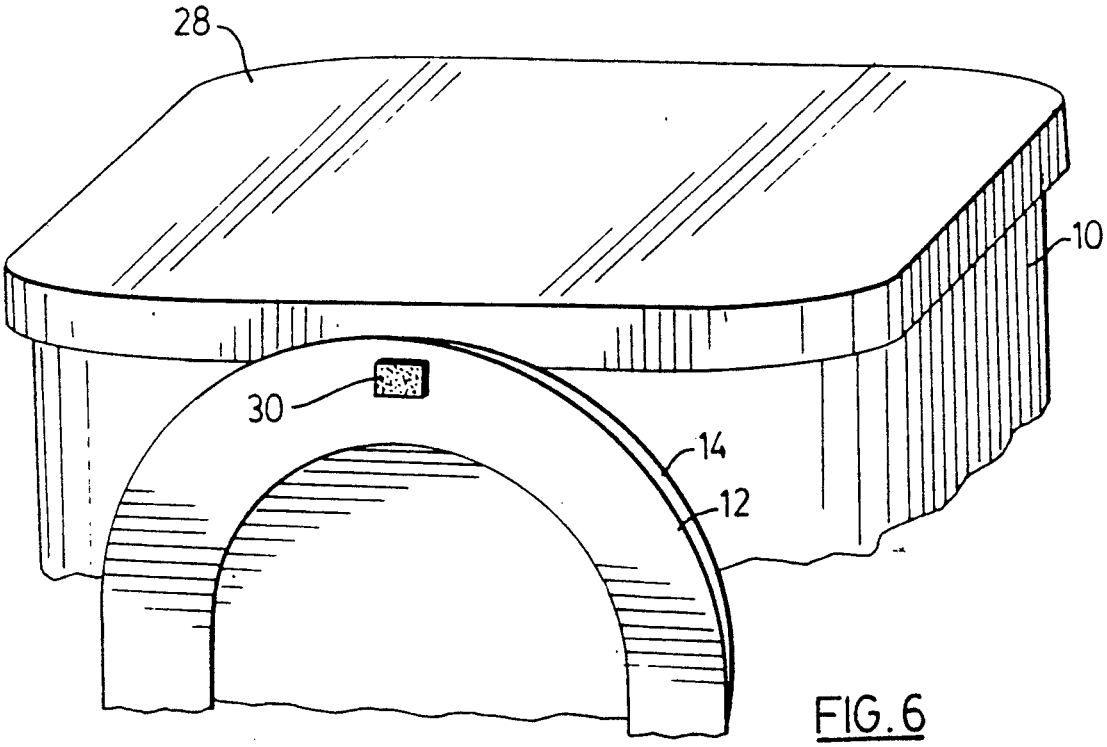
FIG. 6 is a partial isometric view of a toilet according to FIG. 5 with the latching device not engaged but with the seat and cover in the vertical position.

The other member 30 of the releasable securing means 9 is adhesively backed to enable this member to be attached to the bottom of a toilet seat as shown in FIG. 6.

Figure 4:
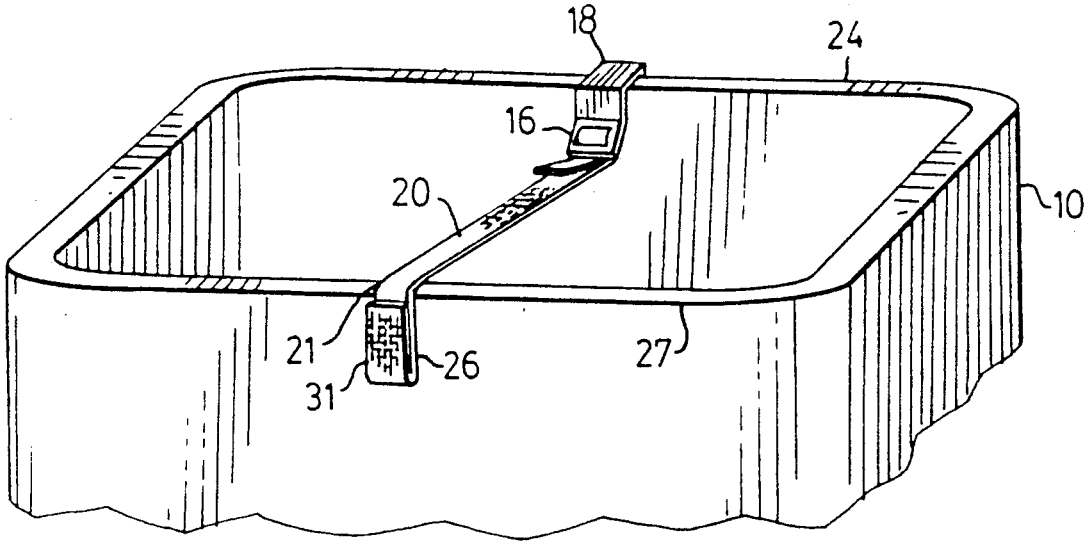
FIG. 4 is a partial isometric view of a toilet with a latching device according to the present invention installed but not engaged.

Referring to FIG. 4, the latching device 16 is shown installed on a water tank 10 of a toilet. The hook 18 of the latching device 16 is shown placed over the top of the rear wall 24 of the water tank 10. The second end 21 is shown hanging over the top of the front wall 27 of the water tank 10.

Figure 5:
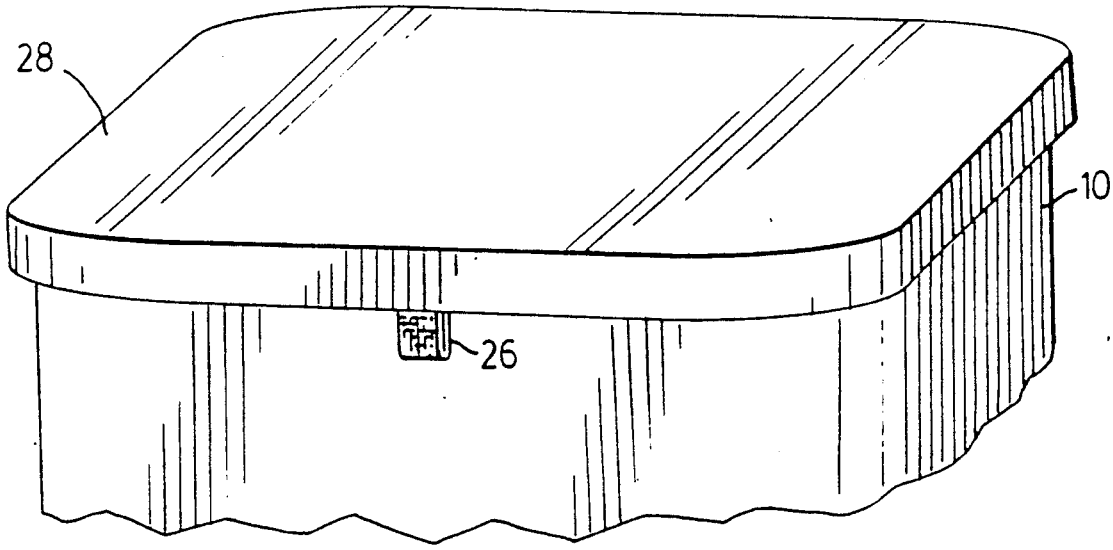
FIG. 5 is a partial isometric view of a toilet according to FIG. 4 but with a lid for the water tank in place over the latching device.

Preferably the length of the strap 20 will be chosen to enable a sufficient portion of the second end 21 to hang freely over the front wall 27 of the tank 10 to permit grasping by a user when a lid 28 in FIG. 5 is placed on the tank 10.

In choosing the length of the strap 20, it is also important to ensure that when the second end 21 of the strap 20 is released from a position where the strap 20 is stretched, the end 21 will retract to a point where only a portion of the end 21 of sufficient length to permit grasping remains visible, but that as the strap 20 retracts between the lid 28 and the water tank 10, and as the weight of the lid 28 placed on the water tank 10 creates friction on the retracting strap 20, the second end 21 of the strap 20 will not retract completely underneath the lid 28 but will instead come to rest with a portion visible.

Taking into account the distance between the front wall 27 and the rear wall 24 of the water tank 10 and the necessary length of the strap 20 hanging freely over the front wall 27, the strap will typically be between 8½ inches and 12 inches.

The head piece 31 on the end 21 of the strap 20 would typically be selected to blend with the outside of the water tank 10 to reduce the visibility of the device when not in use. It would typically be made of plastic or cloth.

Figure 7:
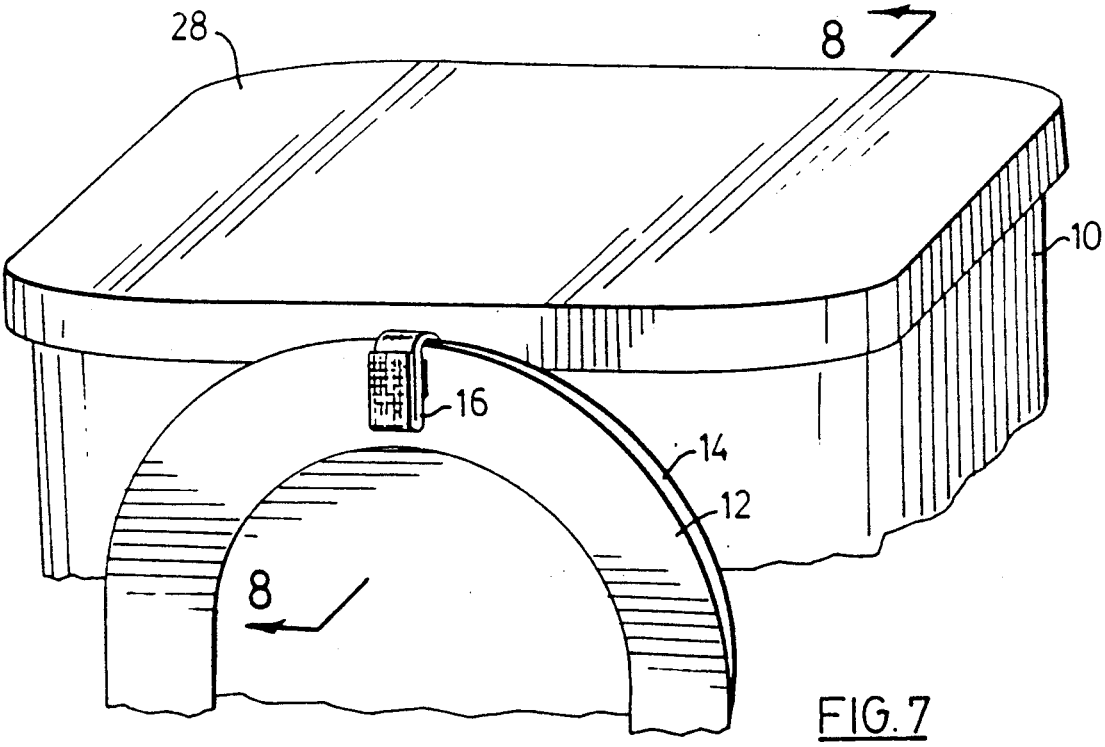
FIG. 7 is a partial isometric view according to FIG. 6 but with the latching device engaged.
Figure 8:
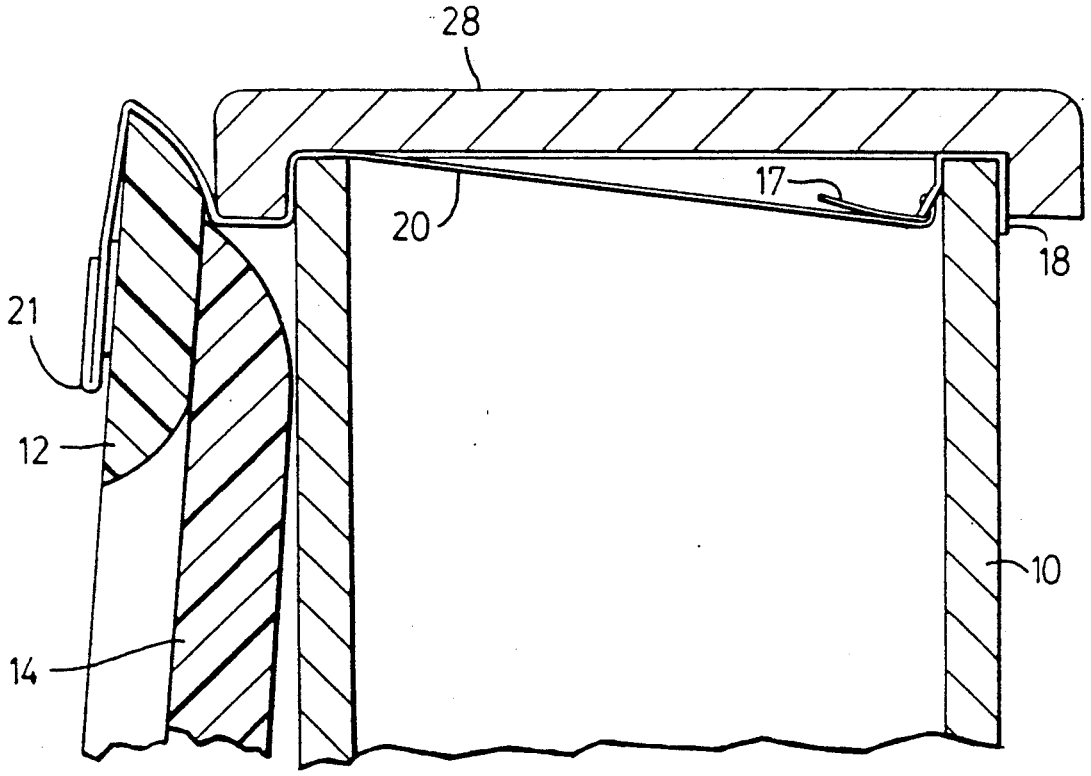
FIG. 8 is a sectional view on line 8—8 of FIG. 7 of the top portion of a toilet.

FIGS. 7 and 8 show the latching device 16 in its engaged position. In use, the second end 21 of the latching device 16 is grasped and pulled over the seat 12 and cover 14 when they are in their respective upright or open positions and both members 22 and 30 of the releasable securing means 9 are stuck to one another.

The above description is to be interpreted in an illustrative rather than a limiting sense bearing in mind that variations may be apparent to those skilled in the art while staying within the spirit and scope of the present invention as set out in the appended claims. For example, although an elastic strap 20 has been described, a non-elastic strap might be used if the greater exposed visible portion of the device is acceptable. Furthermore the hook 18 may be attached to the front wall 27 of the toilet tank 10, however, this will require a greater portion of the device to be exposed to enable enough elastic to be used to provide adequate stretchability. Also, the second member 30 of the releasable securing means 9 could be attached to the bottom of the cover 14 instead of the seat 12. This would have the effect of maintaining only the cover in the vertical position, but not the seat. Finally, the second member 30 of the releasable securing means 9 could be attached by means other than adhesive such as screws or the like.

I claim:

1. A latching device for a toilet having a water tank, a seat, and a cover for said seat, said water tank having a front wall adjacent said seat, a rear wall opposite said front wall and a lid, said latching device comprising:

a resiliently stretchable strap strap having a first end portion opposite a second end portion and a first face opposite a second face;

a hook secured to said first end portion of said strap and dimensioned to mount over an upper edge of said rear wall beneath said lid and attach said first end portion to said rear wall;

releasable securing means at said second end portion of said strap for releasably securing said second end portion of said strap to one of said seat and said cover, said releasable securing means including first and second mating members of a VELCRO type fastener with said first member being securely connected to said first face of said strap and said second member having an adhesive backing for attachment to said one of said seat and said cover;

a head piece covering said second face of said strap or said second end portion, said head piece being of a material visually compatible with said tank;

said strap when in a relaxed state having a length selected to span said walls beneath said lid and extend beyond said front wall, said second end portion of said strap when in the relaxed state having a protruding portion which is completely covered by said head piece.

2. A latching device according to claim 1 wherein said strap has a length of from 8½ to 12 inches.

* * * * *